US005547350A

United States Patent [19]

Rawal et al.

[11] Patent Number: 5,547,350

[45] Date of Patent: Aug. 20, 1996

[54] MODULAR SHAFTLESS COMPRESSOR

[75] Inventors: Dharamendra N. Rawal, Waukesha, Wis.; Philippe Auber, LeHavre, France

[73] Assignee: Dresser-Rand Company, Corning, N.Y.

[21] Appl. No.: 356,671

[22] Filed: Dec. 15, 1994

[51] Int. Cl.[6] ..... F04B 35/04

[52] U.S. Cl. ..... 417/354; 417/356; 417/423.5; 417/423.12

[58] Field of Search ..... 417/354, 423.5, 417/423.12, 423.14, 356

[56] References Cited

U.S. PATENT DOCUMENTS

| | | | |
|---|---|---|---|
| 1,071,042 | 8/1913 | Fuller | 417/356 X |
| 2,535,695 | 12/1950 | Pezzillo, Jr. . | |
| 2,537,310 | 1/1951 | Lapp | 417/356 |
| 3,132,595 | 5/1964 | Bowl et al. | 417/354 |
| 3,723,028 | 3/1973 | Bottoms et al. | 417/356 |
| 3,933,416 | 1/1976 | Donelian | 417/354 |
| 3,938,913 | 2/1976 | Isenberg et al. | 417/356 |
| 4,043,706 | 8/1977 | Walker | 417/353 |
| 4,648,808 | 3/1987 | Hauenstein | 417/353 |
| 4,688,998 | 8/1987 | Olsen et al. | 417/356 |
| 4,806,080 | 2/1989 | Mizobuchi et al. | 417/353 |
| 5,078,741 | 1/1992 | Bramm et al. | 417/365 X |
| 5,112,202 | 5/1992 | Oshima et al. | 417/423.7 |
| 5,114,317 | 5/1992 | Cohen | 417/354 |
| 5,209,650 | 5/1993 | Lemieux | 417/423.5 X |
| 5,256,038 | 10/1993 | Fairman | 417/423.14 X |

OTHER PUBLICATIONS

George S. McLean, "Early Gas Pipeline Operating Experience with the MOPICO Motor Compressor System" presented at the Apr. 1992 Revolve Conference.

*Primary Examiner*—Richard E. Gluck
*Attorney, Agent, or Firm*—Richards, Medlock & Andrews

[57] ABSTRACT

A shaftless compressor module has a module casing containing an axial chamber and an annular chamber which is coaxial with the axial chamber. An annular motor stator can be fixedly positioned in the annular chamber coaxially with the longitudinal axis of the axial chamber. An annular motor rotor can be positioned in the annular chamber coaxially with the annular motor stator. A shaftless impeller is rotatably mounted within the axial chamber. The impeller has a plurality of impeller passageways, with one end of each passageway being open to the inlet of the module casing and the other end of each passageway being located in a radially outer periphery of the impeller. Magnetic bearings can counter axial thrust and radial thrust. Annular gas seals can prevent gas flow through the second chamber. A plurality of these modules can be connected together to form a multiple stage shaftless compressor wherein each impeller can be driven at a different speed. Two compressor modules can be connected together by a communication module so that the two compressor modules can have a common output or be in series with or without an intermediate side stream.

20 Claims, 5 Drawing Sheets

FIG. 3
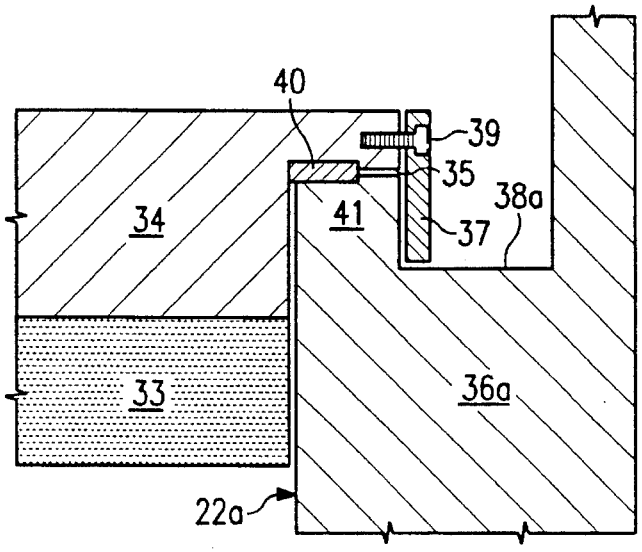
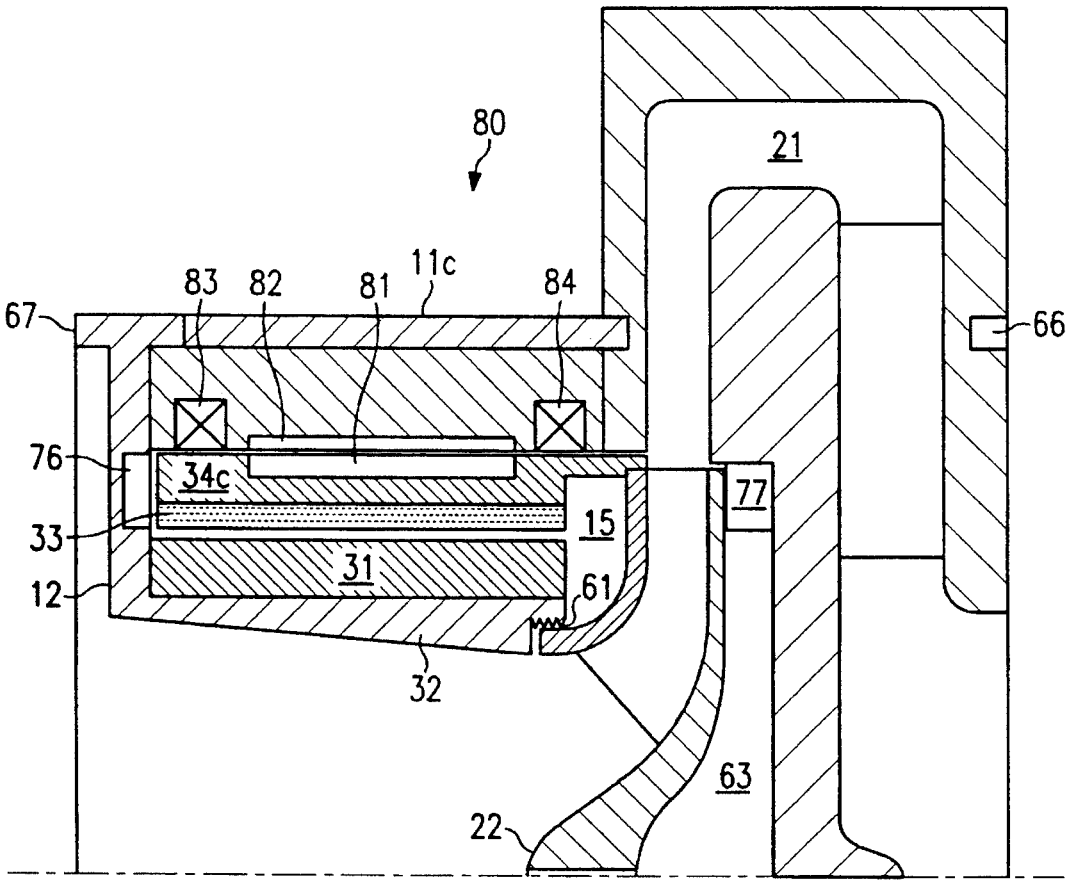
FIG. 5

MODULAR SHAFTLESS COMPRESSOR

FIELD OF THE INVENTION

The invention relates to a centrifugal compressor with a shaftless impeller. In one aspect the invention relates to a compressor formed of a plurality of modules, with at least one module having a shaftless impeller. In another aspect the invention relates to a centrifugal compressor formed of a plurality of shaftless compressor modules connected together in series, with each compressor module having a speed control for driving the respective impeller at different speeds.

BACKGROUND OF THE INVENTION

In a conventional multi-stage centrifugal compressor, a long shaft is required to drive the corresponding plurality of impellers. A long shaft limits the speed at which the compressor can be operated, and causes vibration problems. Impellers cannot exceed a certain speed limit for a given impeller tip diameter because this speed limit is set by aerodynamic considerations. However, when impellers are mounted on a shaft, the impeller tip diameters have to be increased to compensate for the diameter of the shaft, thereby limiting the speed at which the impellers can be operated.

For a given rotational speed of a conventional compressor, only a limited number of impellers can be mounted on a single shaft. While this problem can be avoided in a particular application by employing a plurality of multi-stage centrifugal compressors, the cost of the system is substantially increased.

The conventional centrifugal compressor also requires seals at both ends of the shaft, as the drive for the compressor is located exteriorly of the compressor housing. As an external driver drives all of the impellers in a single centrifugal compressor through a single shaft, a custom coupling is needed to satisfy high torque requirements, thereby increasing the costs of the system.

SUMMARY OF THE INVENTION

A shaftless compressor module has a module casing containing an axial chamber and an annular chamber which is coaxial with the axial chamber. An annular motor stator can be fixedly positioned in the annular chamber coaxially with the longitudinal axis of the axial chamber. An annular motor rotor is positioned in the annular chamber coaxially with the motor stator. In a presently preferred embodiment, the motor rotor is fixed to the interior of a rotor sleeve and is mounted radially outwardly from the motor stator.

A shaftless impeller is rotatably mounted within the axial chamber. The impeller has a plurality of impeller passageways, with one end of each passageway being open to the inlet of the module casing and the other end of each passageway being located in a radially outer periphery of the impeller. A radial peripheral portion of the impeller can be connected to the motor rotor for rotation therewith.

Magnetic bearings can be positioned in the module casing to counter axial thrust and radial thrust of the impeller. Gas seals can be positioned to prevent gas flow through the annular chamber.

A plurality of these modules can be connected together to form a multiple stage shaftless compressor wherein each impeller can be driven at a different speed. Two compressor modules can be connected together by a communication module so that the two compressor modules can have a common output or be in series with or without an intermediate side stream. Such side stream can be either an inflowing stream, adding material to the effluent from the first compressor module, or an out-flowing stream, extracting a portion of the effluent from the first compressor module.

BRIEF DESCRIPTION OF THE DRAWINGS

FIG. 3 is a detail cross section of a connection of the impeller to the rotating sleeve in an embodiment wherein the outer diameter of the rotating sleeve is smaller than the outer diameter of the impeller;

FIG. 5 is a cross section, along a vertical plane containing the longitudinal axis, of the top half of a shaftless compressor module in accordance with a third embodiment of the invention;

DETAILED DESCRIPTION

Figure 1:
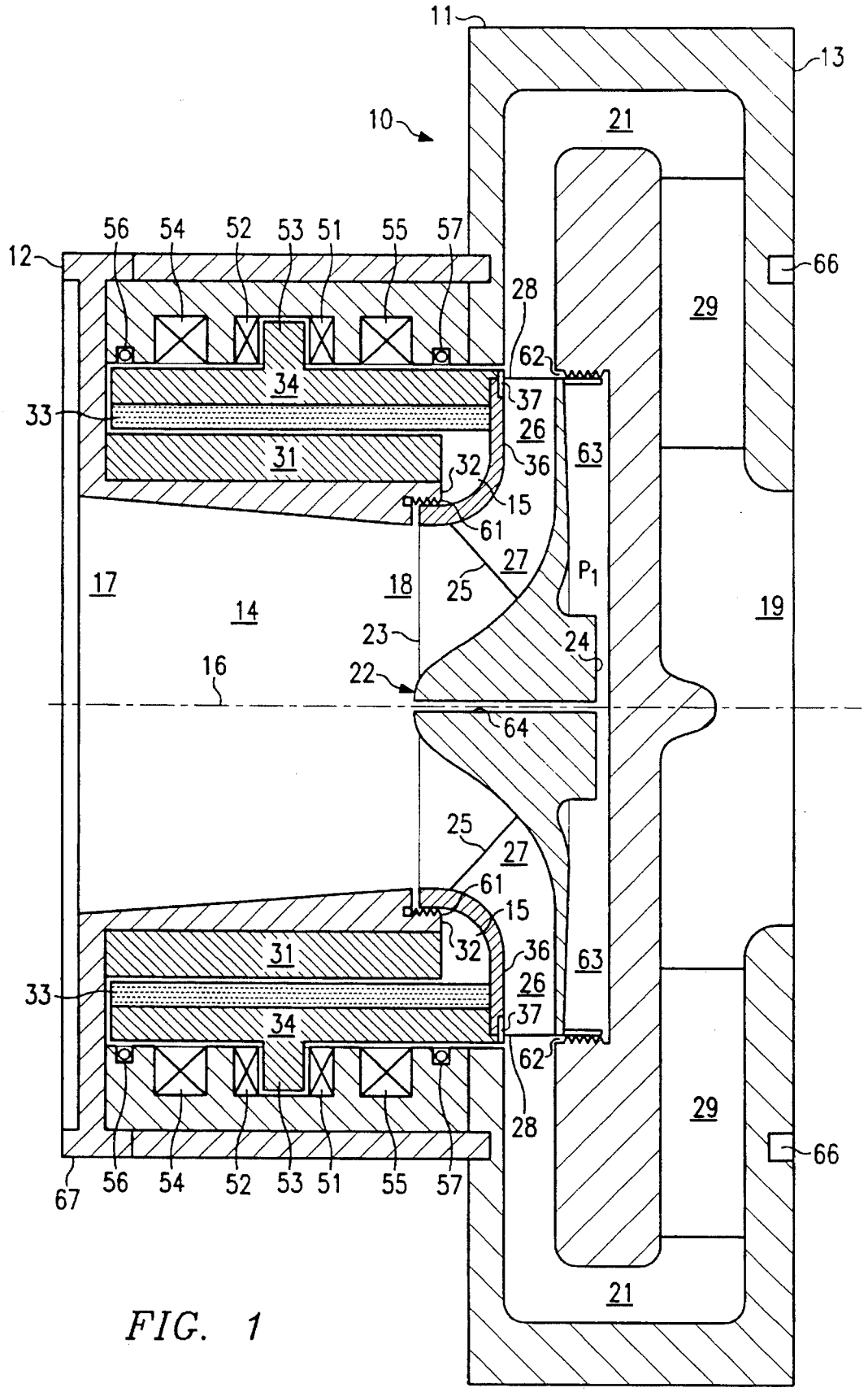
FIG. 1 is a cross section, along a vertical plane containing the longitudinal axis, of a shaftless compressor module in accordance with a first embodiment of the invention.

A shaftless compressor module 10 in accordance with a first embodiment of the invention is illustrated in FIG. 1. The shaftless compressor module 10 has a module casing 11 having an inlet end 12 and an outlet end 13. The module casing 11 has an axially extending first chamber 14 and an annular second chamber 15 formed therein. The longitudinal axis 16 of the first chamber 14 is also the longitudinal axis of the compressor module 10. The annular chamber 15 is positioned in the module casing 11 radially outwardly from the axially extending chamber 14 so that the central axis of the annular chamber 15 coincides with the longitudinal axis 16.

The axially extending chamber 14 has an inlet 17 and an outlet end portion 18, with the inlet 17 being formed in the inlet end 12 of the module casing 11 and preferably being coaxial with the longitudinal axis 16. The module casing 11 has a high pressure outlet 19 in the outlet end 13 of the module casing 11, with the high pressure outlet 19 preferably being coaxial with the longitudinal axis 16. The module casing 11 has a high pressure passageway 21 extending at least generally radially outwardly from the outlet end portion 18 of the axially extending chamber 14 and then at least generally radially inwardly to the high pressure outlet 19.

A shaftless impeller 22 is rotatably mounted within the outlet end portion 18 of the axially extending chamber 14 for rotation about the longitudinal axis 16. The shaftless impeller 22 has an upstream end 23 and a downstream end 24, with a plurality of impeller blades 25 forming generally radially extending impeller passageways 26. The upstream end 27 of each of the plurality of impeller passageways 26 is open to axially extending chamber 14 so as to be in fluid communication with the inlet 17, while the downstream end 28 of each of the plurality of impeller passageways 26 is located in a radially outer periphery of the shaftless impeller 22 and in fluid communication with the passageway 21. The passageway 21 can be provided with a plurality of static vanes 29 to control the direction of flow of fluid through the passageway 21. The portion of the axially extending chamber 14 between the inlet 17 and the upstream end of impeller 22 is preferably in the form of a frustoconical chamber with the diameter of the inlet 17 being greater than the diameter of the chamber 14 at the upstream end of the impeller 22.

An annular motor stator 31 is positioned in the annular chamber 15 and fixedly secured to the annular wall 32 which forms the axially extending chamber 14, with the motor stator 31 being coaxial with the longitudinal axis 16. An annular motor rotor 33 is also positioned in the annular chamber 15 radially outwardly from the annular motor stator 31 so as to be coaxial with the annular motor stator 31 and with the longitudinal axis 16. At least one annular bearing is positioned radially outwardly from the annular motor rotor 33 to serve as a rotational bearing for the motor rotor 33. In the first embodiment, an annular bearing sleeve 34 is positioned in the annular chamber 15 radially outwardly from the annular motor rotor 33 so as to be coaxial with the annular motor rotor 33 and with the longitudinal axis 16, with the annular bearing sleeve 34 being connected to the annular motor rotor 33 for rotation therewith. The downstream end of the annular bearing sleeve 34 is attached to the radially outer peripheral portion of the impeller 22 by an interference fit and, if necessary in view of torque requirements, by a key 40, so that the impeller 22 is rotated by the annular bearing sleeve 34 in response to a rotation of the annular motor rotor 33 by the annular motor stator 31.

Figure 2:
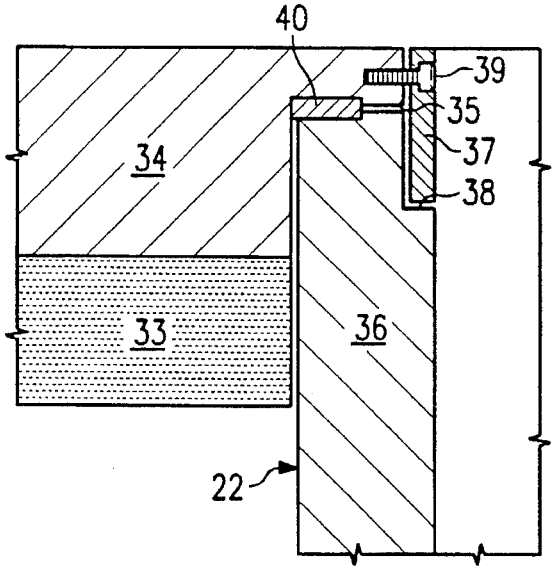
FIG. 2 is a detail cross section of a connection of the impeller to the rotating sleeve in an embodiment wherein the outer diameter of the rotating sleeve is greater than the outer diameter of the impeller.

As shown in FIG. 2, where the guter diameter of the bearing sleeve 34 is greater than the outer diameter of impeller 22, the downstream end of the annular bearing sleeve 34 can be provided with an annular recess 35 on its inner surface to receive the radially outermost portion of the upstream wall 36 of impeller 22. An annular ring member 37 can be positioned in an annular groove 38 in the upstream wall 36 and bolted to the downstream end of the annular bearing sleeve 34 with a plurality of bolts 39 so as to secure the outer peripheral portion of the impeller 22 to the bearing sleeve 34. A key 40, which engages both the impeller 22 and the annular bearing sleeve 34, can be employed to prevent rotation of the annular bearing sleeve 34 relative to the impeller 22.

Alternatively, as shown in FIG. 3, where the outer diameter of the bearing sleeve 34 is less than the outer diameter of impeller **22*a*, the upstream portion of the wall 36*a* of impeller 22*a* is provided with a radially reduced portion 41 which mates with the annular recess 35 on the inner surface of the bearing sleeve 34. A radially outwardly facing annular groove 38*a* can be formed in the wall 36*a* to receive the annular ring member 37, so that the radially reduced portion 41 of the impeller wall 36*a* is clamped between the bearing sleeve 34 and the annular ring 37. The annular ring 37** can be a split lock ring in order to facilitate its installation.

In either version of the connecting element, the shaftless impeller 22 or **22*a* is rotated by the annular bearing sleeve 34 in response to a rotation of the annular motor rotor 33 by the annular motor stator 31**.

In the embodiment of FIG. 1, a pair of annular magnetic bearings 51 and 52 are mounted in the housing 11 coaxially with the bearing rotor sleeve 34 and spaced apart from each other along the longitudinal axis 16. The annular bearing sleeve 34 has an annular magnetic bearing thrust ring element 53 extending radially outwardly therefrom into the annular space between the two magnetic bearings 51 and 52, whereby bearings 51 and 52 serve as axial thrust bearings for the bearing rotor sleeve 34 and the impeller 22. The thrust ring element 53 is preferably located at about the midpoint of the length of the bearing rotor sleeve 34. Annular magnetic bearings 54 and 55 are mounted in the housing 11 coaxially with and radially outwardly from the bearing rotor sleeve 34 and spaced apart along the longitudinal axis 16 from each other and from the axial thrust bearings 51 and 52 so as to serve as radial bearings for the bearing rotor sleeve 34 and the impeller 22. If desired, ball bearing races 56 and 57 can also be provided in housing 11 coaxially with the bearing rotor sleeve 34 and preferably located adjacent the opposite ends of the bearing rotor sleeve 34.

An annular gas seal 61 can be positioned between the upstream end 23 of the shaftless impeller 22 and the radially outwardly adjacent portion of the wall 32 of the module casing 11 to provide a gas seal between the axially extending chamber 14 and the annular chamber 15. An annular gas seal 62 can be positioned on the backside of the impeller 22 between the radially outer periphery of the impeller 22 and the radially outwardly adjacent portion of the module casing 11 so as to provide a gas seal between the high pressure passageway 21 and the space 63 between the downstream side of the impeller 22 and the axially adjacent wall of module casing 11. A passage 64 can be formed in impeller 22 to provide fluid communication between the upstream end 23 of impeller 22 and the space 63 so as balance the pressure in space 63 with the pressure at the upstream end 23 of impeller 22. The passage 64 is advantageously formed to be coaxial with longitudinal axis 16. Seals 61 and 62 can be in any suitable form, e.g. labyrinth seals. If the axial thrust carrying capability of the thrust bearings 51 and 52 is high enough, then seal 62 and passage 64 are not required.

The downstream end 13 of module housing 11 can be provided with an annular groove 66 formed therein, while the upstream end 12 of the module housing 11 can be provided with an annular flange or ring 67 formed thereon. The annular groove 66 is coaxial with the longitudinal axis 16 and is dimensioned to receive in sealing engagement therewith an annular flange 67 on the inlet end of a second module casing. Thus, the flange 67 of a first shaftless compressor module can be positioned in the annular groove 66 of a second shaftless compressor module positioned immediately upstream of the first module, or in a similar annular groove in an inlet module or communication module positioned immediately upstream of the first shaftless compressor module. Similarly, the groove 66 of the first shaftless compressor module can receive a similar annular flange 67 of another shaftless compressor module or a communication module or an outlet module positioned immediately downstream of the first shaftless compressor module. Any suitable means can be provided to mechanically secure adjacent modules together to form a plurality of modules in series.

Figure 4:
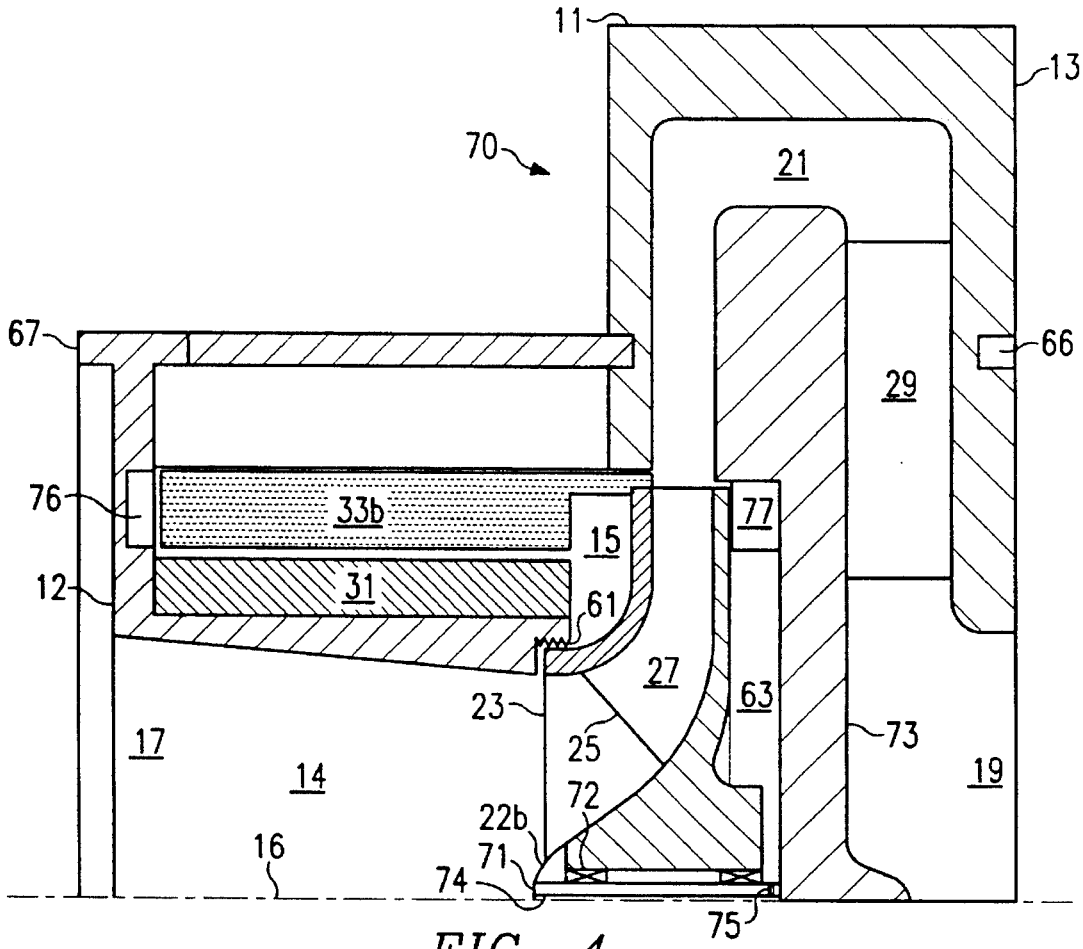
FIG. 4 is a cross section, along a vertical plane containing the longitudinal axis, of the top half of a shaftless compressor module in accordance with a second embodiment of the invention.

Referring now to FIG. 4, a shaftless compressor module 70 in accordance with a second embodiment of the invention is illustrated. Components of this second embodiment which are common to the first embodiment shown in FIG. 1 are given the same reference numerals, and a detailed description of the configuration and the operation of such components is not repeated. One end of the induction motor rotor 33*b* is connected directly to the radially outermost portion of the impeller 22*b*. The impeller 22*b* is rotationally mounted on a cantilevered hub 71 by a sleeve bearing 72. One end of the hub 71 is secured to a radially extending portion 73 of the module housing 11*b* with the longitudinal axis of the hub 71 coinciding with the longitudinal axis 16 such that the hub 71 is cantilevered from the portion 73. The other end of the hub 71 can be supported by a keyed fit to radial ribs attached to the stator support. A longitudinally extending passage 74 and a radially extending passage 75 in hub 71 provide communication between chamber 14 and space 63. A first gas seal thrust bearing 76 is positioned in housing 11*b* adjacent to and in alignment with the end of the induction motor rotor 33*b* remote from impeller 22*b* to serve as a thrust bearing for the motor rotor 33*b* and to provide a gas seal between high pressure passage 21 and the portion of annular chamber 15 radially inwardly of the motor rotor 33*b*. Thus, the first gas seal thrust bearing 76 can provide a seal for the annular gap between the annular motor rotor 33*b* and the annular motor stator 31 as well as for the annular gap between the annular motor rotor 33*b* and the module housing 11. A second gas seal thrust bearing 77 is positioned in housing 11*b* adjacent the radially outermost portion of the backside of impeller 22*b* to serve as a thrust bearing for the impeller 22*b* and the motor rotor 33*b* and to provide a gas seal between the high pressure passage 21 and the space 63.

Referring now to FIG. 5, a shaftless compressor module 80 in accordance with a third embodiment of the invention is illustrated. Components of this third embodiment which are common to the first embodiment shown in FIG. 1 or the second embodiment shown in FIG. 4 are given the same reference numerals, and a detailed description of the configuration and the operation of such components is not repeated.

Passive magnetic bearings 81 and 82 are coaxially mounted on the bearing rotor sleeve 34*c* and the housing 11c, respectively, with the bearing 82 being radially outwardly from the bearing 81. Passive magnetic bearings 81 and 82 can be in the form of permanent magnets. Supportive active magnetic bearings 83 and 84 are positioned in housing 11c adjacent to and radially outwardly from rotor sleeve 34*c*, with bearings 83 and 84 being coaxial with longitudinal axis 16 and spaced apart from each other along the longitudinal axis 16.

Each of these three embodiments of the invention provides the advantages of the rotor being located radially outwardly from the stator. These advantages include the simpler requirements for the assembly and locking of the rotor to the cover of the impeller; the bore of the stator acting as a venturi at the eye of the impeller; and the elimination of a non-rotating guide vane inside the rotor to prevent prewhirl of the gas as it flows along the rotor bore. The combination of the external rotor with the rotor sleeve provides additional advantages in that the location of the rotor windings on the internal diameter of the rotor sleeve enables the rotor to withstand higher speeds and greater centrifugal forces; the inserts in the rotor cannot be centrifuged out, thereby permitting operation at higher speeds; the rotor sleeve doubles as a journal surface, thereby requiring less axial space; and the bearings have larger diameters, thereby requiring less axial space and/or less forces/current for a given load.

Figure 6:
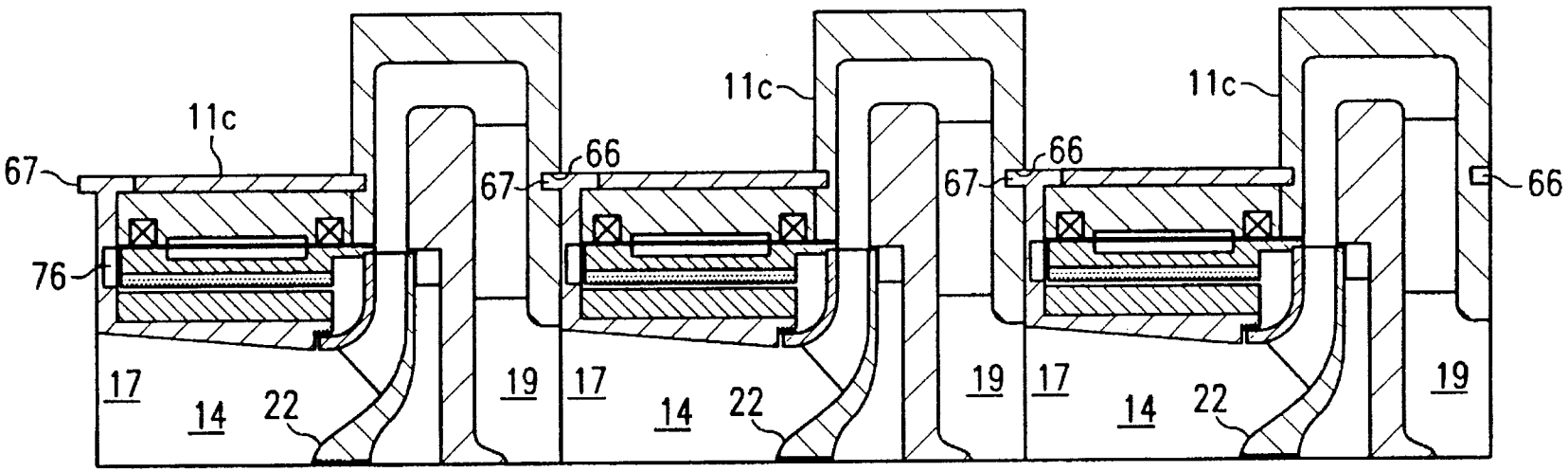
FIG. 6 is a cross section, along a vertical plane containing the longitudinal axis, of a shaftless compressor having three of the modules illustrated in FIG. 5 directly connected together in series.

Referring now to FIG. 6, one version of a shaftless compressor in accordance with the invention is illustrated with three shaftless compressor modules 80 connected in series such that the outlet 19 of the first shaftless compressor module is connected to the inlet 17 of the second shaftless compressor module, while the outlet 19 of the second shaftless compressor module is connected to the inlet 17 of the third shaftless compressor module. Any desired number of these shaftless compressor modules can be stacked together to form a compressor.

Figure 7:
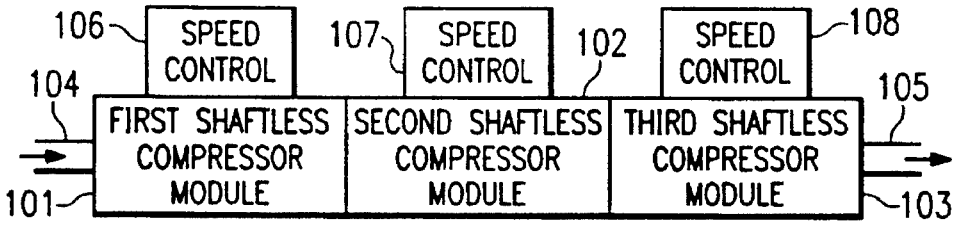
FIG. 7 is a schematic illustration of a modular shaftless compressor containing three compressor modules joined together in series.

Referring now to FIG. 7, a first shaftless compressor module 101, a second shaftless compressor module 102, and a third shaftless compressor module 103 are connected in series between an inlet module 104 and an outlet module 105. The three shaftless compressor modules 101, 102, and 103 are mounted in coaxial alignment with each other. Each of the compressor modules 101, 102, and 103 is provided with an independent speed control unit 106, 107, and 108, respectively.

Figure 8:
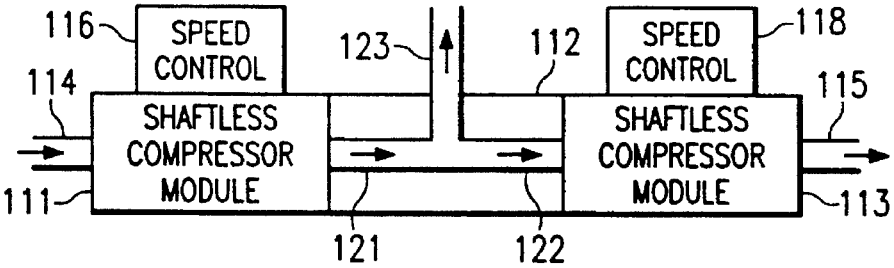
FIG. 8 is a schematic illustration of a modular shaftless compressor containing two compressor modules joined together by a sidestream module for splitting the output of the first compressor module.

Referring now to FIG. 8, a first shaftless compressor module 111, a communication module 112, and a second shaftless compressor module 113 are connected in series between an inlet module 114 and an outlet module 115. Each of the compressor modules 111 and 113 is provided with an independent speed control unit 116 and 118, respectively. The communication module 112 is in the form of a sidestream module. The sidestream module 112 can provide for an in-flowing stream to add material to the effluent 121 from the first compressor module 111 and to pass the resulting combined stream to the inlet of the second compressor module 122, or for an out-flowing stream to extract a portion of the effluent 121 from the first compressor module 111. In this specific illustration, the sidestream module 112 provides for the division of the high pressure fluid stream 121 from the outlet of the first shaftless compressor module 111 into a feedstream 122 to the inlet of the second shaftless compressor module 113 and an out-flowing sidestream 123. The two shaftless compressor modules 111 and 113 can be mounted in coaxial alignment with each other, with each shaftless compressor module passing gas from left to right in this illustration.

Figure 9:
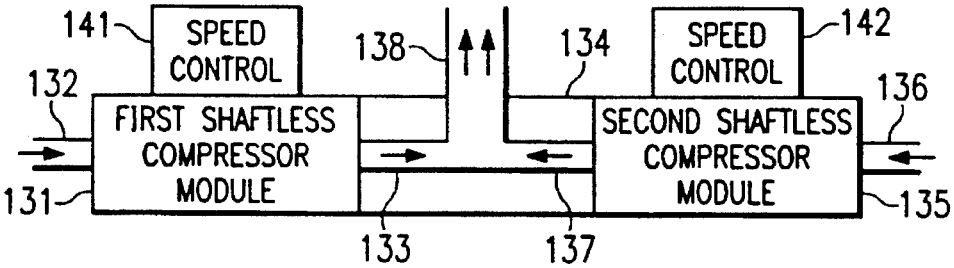
FIG. 9 is a schematic illustration of a modular shaftless compressor containing two compressor modules joined together by a sidestream module for combining the outputs of the two compressor modules.

Referring now to FIG. 9, a first shaftless compressor module 131 is connected between an inlet module 132 and a first inlet 133 of a communication module 134, while a second shaftless compressor module 135 is connected between an inlet module 136 and a second inlet 137 of communication module 134. The two inlets of communication module 134 are connected to a common outlet 138. Each of the compressor modules 131 and 135 is provided with an independent speed control unit 141 and 142, respectively. The communication module 134 provides for the combining of the high pressure fluid stream from the outlet of the first shaftless compressor module 131 and the high pressure fluid stream from the outlet of the second shaftless compressor module 135 into a common output stream. The shaftless compressor modules 131 and 135 can be mounted back-to-back in coaxial alignment with each other so that each shaftless compressor module 131 and 135 is passing compressed gas toward the centrally located communication module 134. The module 131 can be identical to or different from module 135.

A shaftless compressor module in accordance with the present invention eliminates any need for a rotor shaft as well as eliminating any need for the impellers to be on a common shaft. A shaftless compressor module in accordance with the present invention replaces the rotor shaft by a rotating sleeve, which can be the motor rotor or an annular sleeve mounted on the motor rotor. A shaftless compressor module in accordance with the present invention supports the impeller at the outer rim of the impeller, and provides for radial placement of motor and bearings in the housing separate and distinct from the impeller, facilitating replacement of an impeller with a second impeller of a different design. A shaftless compressor module in accordance with the present invention eliminates several of the seals required on conventional compressors, e.g. seals before and after a bearing, as the motor for driving the impeller is positioned within the compressor housing. The smaller sealing surfaces provided by the invention results in less leakage loss. A shaftless compressor module in accordance with the present invention also eliminates any need for custom couplings.

The present invention facilitates the standardization of parts of a compressor in that a compressor can be fabricated from the desired number of shaftless compressor modules, a sidestream takeoff module can be readily positioned at the outlet of a selected shaftless compressor module, and one or more shaftless compressor modules can be readily provided with different design impellers without having to redesign the module housing. Thus, a compressor can be fabricated by the assembly and machining of completely standard components, thus reducing the number of parts to be supplied, eliminating custom engineering work, permitting a shorter delivery period, and permitting easier upgrades.

The use of passive magnetic bearings in the third embodiment of the invention to provide load carrying capacity and back-up support in case of failure of the active magnetic bearings dramatically reduces the cost of the bearings as well as reducing power requirements.

The elimination of a main compressor rotor shaft substantially reduces or eliminates the problem of vibrations, and eliminates the limit on the number of possible stages. The elimination of a main compressor rotor shaft means smaller impeller diameters, which indicates that a greater rotating speed is possible. The speed limit for each impeller is set by the rotor rather than by the combination of the shaft and the impeller blades. Also, in the present invention the impellers can be operated at different speeds so that each impeller could work at its peak conditions. The invention provides for better surge and choke control through controlling the speed of each impeller individually.

Reasonable variations and modifications are possible within the scope of the foregoing description, the drawings and the appended claims to the invention.

That which is claimed is:

1. A shaftless compressor module comprising:

a module casing having an inlet end and an outlet end, said module casing having a first chamber and a second chamber therein, said first chamber having a longitudinal axis, said second chamber being an annular chamber having a central axis and being positioned in said module casing radially outwardly from said first chamber so that said central axis coincides with said longitudinal axis of said first chamber, said module casing having an inlet to said first chamber and an outlet from said first chamber;

an annular motor stator fixedly positioned in said second chamber so as to be coaxial with said longitudinal axis of said first chamber;

an annular motor rotor positioned in said second chamber radially outwardly from said annular motor stator so as to be coaxial with said annular motor stator and with said longitudinal axis of said first chamber;

a shaftless impeller, said shaftless impeller being rotatably mounted within said first chamber of said module casing for rotation about said longitudinal axis of said first chamber, said shaftless impeller having a first end and a second end, said shaftless impeller having a plurality of impeller blades forming impeller passageways, with one end of each of said plurality of impeller passageways being in fluid communication with said inlet of said first chamber and the other end of each of said plurality of impeller passageways being located in a radially outer periphery of said shaftless impeller and in fluid communication with said outlet from said first chamber.

2. A shaftless compressor module in accordance with claim 1 further comprising an annular gas seal positioned between said first end of said shaftless impeller and said module casing.

3. A shaftless compressor module in accordance with claim 1, wherein said inlet to said first chamber is located in the inlet end of said module casing and is coaxial with said longitudinal axis, wherein said module casing has a high pressure outlet in the outlet end of said module casing with said high pressure outlet being coaxial with said longitudinal axis, wherein said module casing has a high pressure passageway extending radially outwardly from said outlet of said first chamber and then radially inwardly to said high pressure outlet, wherein said inlet end of said module casing has an annular ring extending longitudinally outwardly therefrom, and wherein said outlet end of said module casing has an annular groove formed therein which is coaxial with said longitudinal axis and dimensioned to receive in sealing engagement therewith an annular ring on an inlet end of a second module casing.

4. A shaftless compressor module in accordance with claim 1 further comprising an annular bearing positioned radially outwardly from said annular motor rotor.

5. A shaftless compressor module in accordance with claim 1, further comprising an annular bearing sleeve having a first end and a second end and being positioned in said second chamber radially outwardly from said annular motor rotor so as to be coaxial with said annular motor rotor and with said longitudinal axis of said first chamber, said annular bearing sleeve being connected to said annular motor rotor for rotation therewith, said second end of said annular bearing sleeve being connected to a radially outer peripheral portion of said shaftless impeller so that said shaftless impeller is rotated by said annular bearing sleeve in response to a rotation of said annular motor rotor by said annular motor stator.

6. A shaftless compressor module in accordance with claim 5, wherein said shaftless compressor module further comprises at least one annular magnetic bearing positioned radially outwardly from said annular bearing sleeve.

7. A shaftless compressor module in accordance with claim 6, wherein said at least one annular magnetic bearing comprises first and second annular magnetic radial bearings spaced apart along said longitudinal axis.

8. A shaftless compressor module in accordance with claim 5, further comprising first and second annular magnetic thrust bearings spaced apart along said longitudinal axis, and wherein said annular bearing sleeve has an annular bearing element extending radially outward therefrom, with said annular bearing element being positioned between said first and second annular magnetic thrust bearings.

9. A shaftless compressor module in accordance with claim 5, further comprising an annular thrust bearing mounted in said module casing adjacent to and in alignment with said first end of said annular bearing sleeve.

10. A shaftless compressor module in accordance with claim 6, wherein said annular bearing sleeve has at least one magnetic element therein, and wherein each of said at least one magnetic element and said at least one annular magnetic bearing comprises a permanent magnet.

11. A shaftless compressor module in accordance with claim 1, wherein said annular motor rotor has a first end and a second end, at least one connector element connecting said second end of said annular motor rotor to a radially outer peripheral portion of said shaftless impeller so that said shaftless impeller is rotated by said annular motor rotor.

12. A shaftless compressor module in accordance with claim 1, wherein said annular motor rotor has a first end and a second end, said second end of said annular motor rotor being connected to a radially outer peripheral portion of said shaftless impeller so that said shaftless impeller is rotated by said annular motor rotor, and further comprising a first annular thrust bearing positioned in said module casing adjacent to said first end of said annular motor rotor so as to provide a thrust bearing for said annular motor rotor and to provide a gas seal between an annular gap between said annular motor rotor and said annular motor stator and an annular gap between said annular motor rotor and said module casing.

13. A shaftless compressor module in accordance with claim 12, further comprising a second annular thrust bearing positioned between said module casing and said second end of said shaftless impeller adjacent said radially outer periphery of said shaftless impeller so as to provide a thrust bearing for said shaftless impeller and to provide a gas seal between said second end of said shaftless impeller and said radially outer periphery of said shaftless impeller.

14. A shaftless compressor comprising a plurality of shaftless compressor modules, each of said modules comprising:

a module casing having an inlet end and an outlet end, said module casing having a first chamber and a second chamber therein, said first chamber having a longitudinal axis, said second chamber being an annular chamber having a central axis and being positioned in said module casing radially outwardly from said first chamber so that said central axis coincides with said longitudinal axis of said first chamber, said module casing having an inlet to said first chamber and an outlet from said first chamber;

an annular motor stator fixedly positioned in said second chamber so as to be coaxial with said longitudinal axis of said first chamber;

an annular motor rotor positioned in said second chamber so as to be coaxial with said annular motor stator and with said longitudinal axis of said first chamber;

a shaftless impeller, said shaftless impeller being rotatably mounted within said first chamber of said module casing for rotation about said longitudinal axis of said first chamber, said shaftless impeller having a first end and a second end, said shaftless impeller having a plurality of impeller blades forming impeller passageways, with one end of each of said plurality of impeller passageways being in fluid communication with said inlet of said first chamber and the other end of each of said plurality of impeller passageways being located in a radially outer periphery of said shaftless impeller and in fluid communication with said outlet from said first chamber.

15. A shaftless compressor in accordance with claim 14, wherein said plurality of shaftless compressor modules are mounted with respect to each other so that the longitudinal axis of one of said plurality of modules is in alignment with the longitudinal axis of each of the other modules.

16. A shaftless compressor in accordance with claim 14, wherein the inlet to each first chamber is located in the inlet end of the respective module casing and is coaxial with each longitudinal axis, wherein each module casing has a high pressure outlet in the outlet end of the respective module casing with the high pressure outlet being coaxial with each longitudinal axis, and wherein each module casing has a high pressure passageway extending radially outwardly from the outlet of its first chamber and then radially inwardly to its high pressure outlet.

17. A shaftless compressor in accordance with claim 16, wherein the inlet end of a second one of said module casings has an annular ring extending longitudinally outwardly therefrom, wherein the outlet end of a first one of said module casings has an annular groove formed therein which is coaxial with each longitudinal axis and dimensioned to receive in sealing engagement therewith the annular ring on the inlet end of said second one of said module casings, and wherein the high pressure outlet of a first one of said module casings is connected to the inlet to the first chamber or a second one of said module casings, whereby the first one and the second one of said compressor modules are connected in series.

18. A shaftless compressor in accordance with claim 16, wherein each of said plurality of shaftless compressor modules is provided with a speed controller for controlling the rotation of the annular motor rotor of the respective shaftless compressor module, whereby each one of said plurality of shaftless compressor modules can be driven at a speed which is different from the speed of at least one other one of said plurality of shaftless compressor modules.

19. A shaftless compressor in accordance with claim 14, further comprising a communication module connecting an outlet end of a first one of said compressor modules with an inlet end of a second one of said compressor modules.

20. A shaftless compressor in accordance with claim 14, wherein each of said plurality of shaftless compressor modules is provided with a speed controller for controlling the rotation of the annular motor rotor of the respective shaftless compressor module, whereby each one of said plurality of shaftless compressor modules can be driven at a speed which is different from the speed of at least one other one of said plurality of shaftless compressor modules.

* * * * *

UNITED STATES PATENT AND TRADEMARK OFFICE

CERTIFICATE OF CORRECTION

PATENT NO. : 5,547,350

DATED : August 20, 1996

INVENTOR(S) : Rawal et al

It is certified that error appears in the above-indentified patent and that said Letters Patent is hereby corrected as shown below:

Column 10, line 32, delete "or" and insert --of--.

Signed and Sealed this

Fifteenth Day of April, 1997

Bruce Lehman

*Attest:*

BRUCE LEHMAN

*Attesting Officer*

*Commissioner of Patents and Trademarks*